United States Patent [19]

Schenck et al.

[11] Patent Number: 5,018,628

[45] Date of Patent: May 28, 1991

[54] WORKING SURFACE

[75] Inventors: Robert Schenck, Manitowoc; Jeffrey H. Hoffman, Two Rivers; Michael N. Klein, Sheboygan; Gene R. Kouba, Two Rivers, all of Wis.

[73] Assignee: Classic Modular Systems, Inc., Two Rivers, Wis.

[21] Appl. No.: 509,878

[22] Filed: Apr. 16, 1990

[51] Int. Cl.[5] ..... A47F 5/00

[52] U.S. Cl. ..... 211/153; 108/27; 312/140.3

[58] Field of Search ..... 211/153, 175; 108/27, 108/90, 64, 69; 312/140.3

[56] References Cited

U.S. PATENT DOCUMENTS

| | | | |
|---|---|---|---|
| 3,101,486 | 8/1963 | Tiller | 108/27 X |
| 3,167,187 | 1/1965 | Sarkisian | 211/153 |
| 3,219,401 | 11/1965 | Mapson | 108/27 X |
| 3,606,508 | 9/1971 | Burnes | 312/140.3 |
| 4,126,365 | 11/1978 | Bryant | 108/27 X |
| 4,713,949 | 12/1987 | Wilcox | 211/153 X |

*Primary Examiner*—Robert W. Gibson, Jr.
*Attorney, Agent, or Firm*—Godfrey & Kahn

[57] ABSTRACT

A working surface including a substantially planar main body having a peripheral edge and first and second ends, the main body further having a male portion made integral with the first end and a female receiving station made integral with the second end, the male and female portions having complimentary shapes whereby individual working surfaces may be releasably joined together in, juxtaposed, end-to-end mating relationship to form a substantially continuous supporting surface.

15 Claims, 3 Drawing Sheets

WORKING SURFACE

BACKGROUND OF THE INVENTION

1. Field of the Invention

The present invention relates to a new and novel working surface for use in laboratories and other business environments, and more particularly to a working surface which includes releasably interlocking and self-aligning portions which permit the individual portions to be easily removed from a working environment thereby permitting the rapid repair or replacement of damaged portions or the convenient maintenance of same.

2. Background of the Invention

The problems and difficulties related to the maintenance of various work surfaces, and more particularly laboratory surfaces, in both the academic and industrial environments have long been recognized. More particularly, the aforementioned working surfaces have tended to deteriorate over time due to the damaging effects of repeated and prolonged exposure of same to caustic substances such as acids and other organic materials, as well as repeated exposures to heat from laboratory burners and the like. Under these circumstances, traditional laboratory work surfaces have tended to fade, discolor, crack, and otherwise degrade following prolonged exposure to these environmental conditions, over the course of time, unless afforded some form of protection or periodic preventive maintenance. It has also been known that prolonged exposure of these same laboratory working surface to water can cause the joints of traditionally manufactured laboratory work surfaces to become weak, and as a consequence eventually leak with the result that the cabinets and other structures and surfaces positioned immediately below these working surfaces are exposed to same.

While some damaged or degraded laboratory surfaces may be protected or otherwise maintained in serviceable condition by continuous preventive maintenance, seriously damaged laboratory surfaces often require expensive repair or replacement of the effected areas. As should be appreciated, if the damaged area is not repaired or replaced, diminution of the economic value of the laboratory equipment results. Further, laboratory experiments or research could potentially be effected by damaged working surfaces inasmuch as contamination such as leaking substances escaping from the damaged working surfaces to the storage areas located immediately below same can contaminate implements or vessels which may be employed in the experiments or research. Such may be the case in pathology or medical microbiology departments wherein the contamination may encourage the growth of bacteria and viruses which are present in these environments.

In addition to the aforementioned problems related to the difficult repair or replacement of damaged laboratory surfaces, the prior art laboratory surfaces present other significant problems which results from characteristics inherent in their individual design. For example, the prior art laboratory surfaces have frequently been of such a design that they are inconvenient or almost impossible to disassemble for purposes of reconfiguring the laboratory workspaces to accommodate the needs of the particular technician or research project being undertaken.

Therefore, it has long been known that it would be desirable to have a working surface which releasably and reliably mates with adjoining work surfaces, which is cost effective to manufacture and maintain and which is easy to install.

SUMMARY OF THE INVENTION

Therefore, it is an object of the present invention to provide an improved working surface.

Another object of the present invention is to provide such a working surface which includes first and second portions which are operable to releasably and reliably mate one with the other to provide a substantially continuous surface.

Another object of the present invention is to provide such a working surface which permits discrete portions of the working surface to be easily released from engagement with an adjoining portion thereby permitting convenient repair or replacement.

Another object of the present invention is to provide a working surface which is characterized by ease of utilization, simplicity of construction and which further can be manufactured and maintained at a relatively nominal expense.

Another object of the present invention is to provide a working surface which includes first and second portions each having a supporting surface; a peripheral edge, including forwardly and rearwardly disposed portions; and first and second ends, respectively, and wherein the second end of the first member is disposed in abutting relation relative to the first end of the second member, and wherein a female receiving station is formed in the peripheral edge, and second end of the first member, and wherein the female receiving station includes first and second rib members which are individually disposed- in predetermined spaced relation relative to the supporting surface of the first portion and to each other, the individual ribs oriented in planes which are substantially parallel to the plane of the supporting surface; a male member made integral with the peripheral edge and first end of the second portion and which is operable to releasably mate with the female receiving station, the male member including three spaced ribs which are individually oriented in planes which are substantially parallel to the plane of the supporting surface of the second portion; and a raised edge member disposed along the rearward portion of the peripheral edge of the first and second portions respectively and wherein the first and second portions of the working surface, when disposed in mating relation, provides a substantially continuous supporting surface and wherein the raised edge member operates as a barrier to prevent an object of interest from falling off the rearwardly disposed peripheral edge.

Further objects and advantages of the present invention are to provide improved elements and arrangements thereof in the working surface for the purposes described which are dependable, economical, durable and fully effective in accomplishing their intended purposes.

DESCRIPTION OF THE PREFERRED EMBODIMENT

Figures 1, 6:
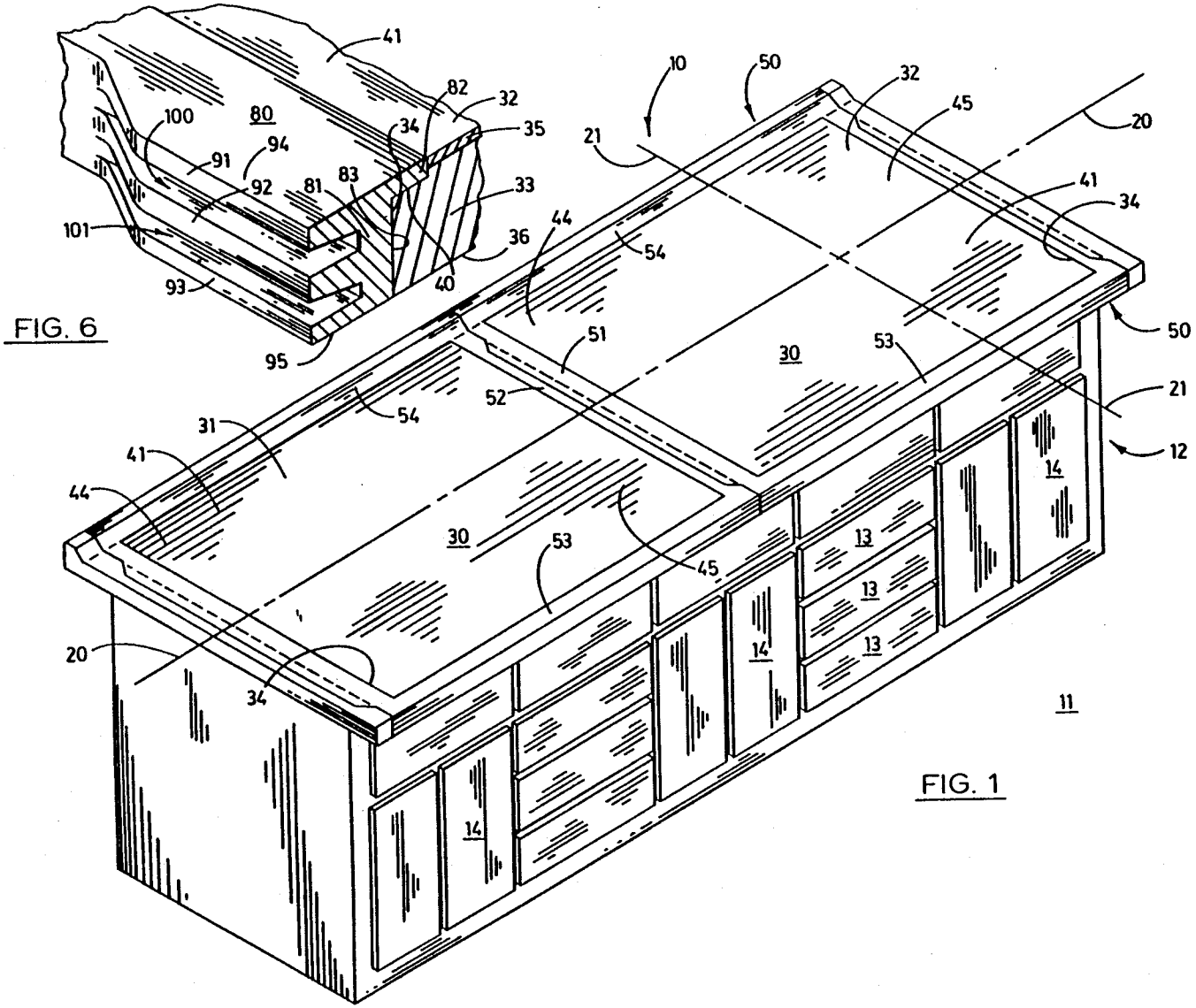
FIG. 1 is a perspective view of the working surface of the present invention shown in a typical operative environment.
FIG. 6 is a fragmentary, transverse, vertical sectional view taken from a position along line 6—6 of FIG. 2.
Figures 2, 5:
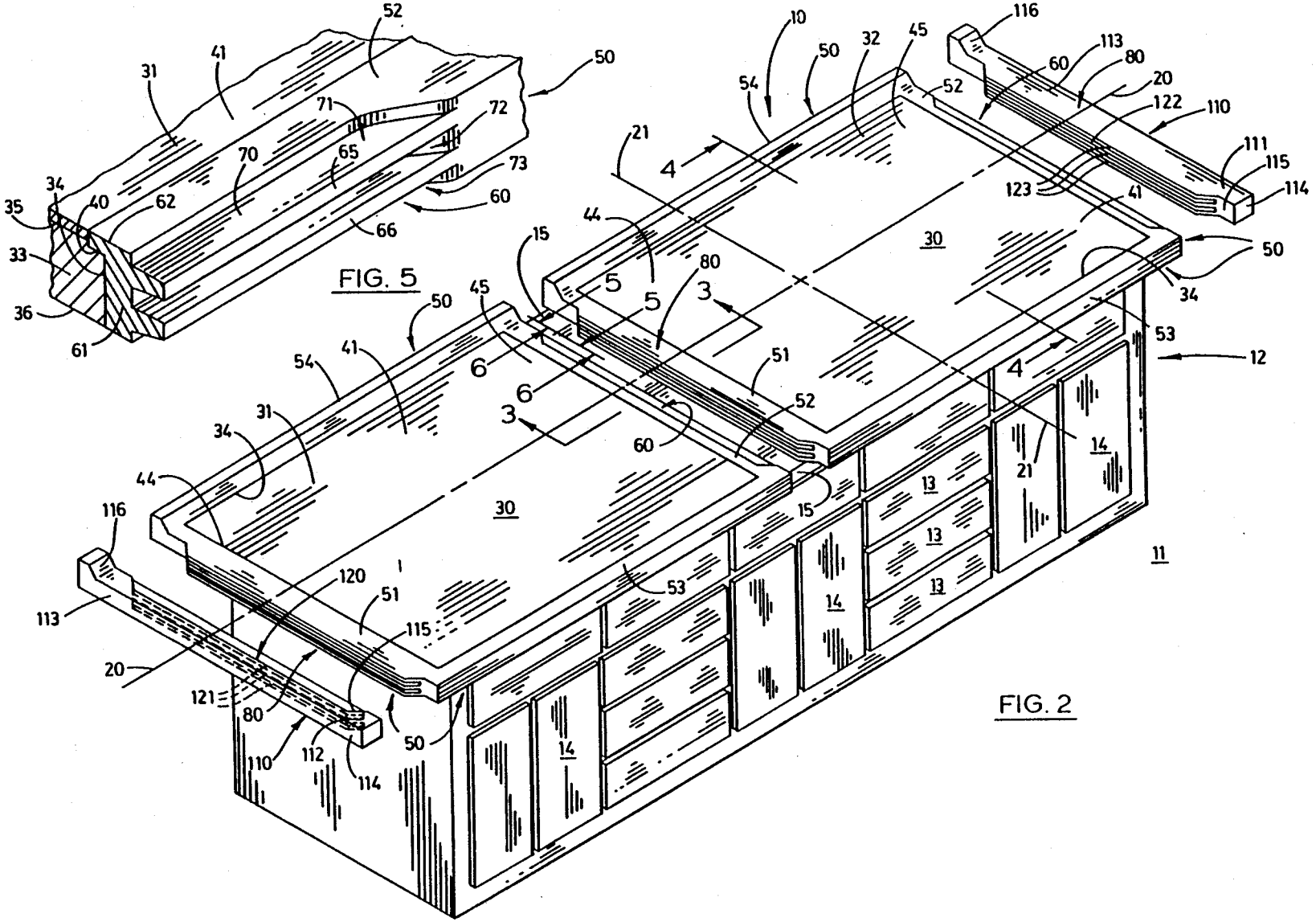
FIG. 2 is a perspective, exploded view, of the working surface of the present invention shown in a typical operative environment.
FIG. 5 is a fragmentary, transverse, vertical sectional view taken from along line 5—5 of FIG. 2.

The working surface of the subject invention is generally indicated by the numeral 10 in FIGS. 1 and 2. The working surface of the subject invention 10 is positioned in spaced relationship relative to a floor or other supporting surface 11 by a cabinet, or base unit 12 which is of substantially conventional design. The base unit includes a plurality of drawers 13 and cabinets 14 which proVide storage spaces for various pieces of equipment and supplies [not shown]. The base unit 12 further includes a top or uppermost supporting frame member 15 which is best seen by reference to FIG. 2. Finally, the base unit has longitudinal and transverse lines of reference 20 and 21, respectively.

The working surface 10 of the present invention includes a pair of discrete sections which are generally indicated by the numeral 30. The discrete sections which will hereinafter be discussed as a first portion 31, and a second portion 32, each include a main body 33 which has a substantially square or rectangular shape. The main body of each of the portions is defined by a peripheral edge 34. Further, each portion has a top surface 35 and an opposite bottom surface 36. As best illustrated by reference to FIGS. 3 and 4, a recessed channel 40 of predetermined dimensions is formed adjacent to the peripheral edge 34 and in the top surface 35 of the individual portions. Further, and affixed to the top surface by suitable adhesive or conventional fasteners is an exterior supporting surface 41 which is typically a material which is both flame, water- and chemical resistant. Examples of suitable supporting surfaces include epoxy resin, Chemsurf® plastic laminate, stainless steel or RTS TM. The main body of each of the portions may be manufactured out of a number of different materials including particle board, plywood, or other natural or synthetic materials. The exterior supporting surface 41 includes an outwardly facing surface 42; and an inwardly facing surface 43 which is adhesively affixed or otherwise secured in mating receipt with the top surface 35 of the first and second portions 31 and 32 respectively. As seen most clearly in FIG. 2 the individual portions have respective first and second ends 44 and 45.

Figure 3:
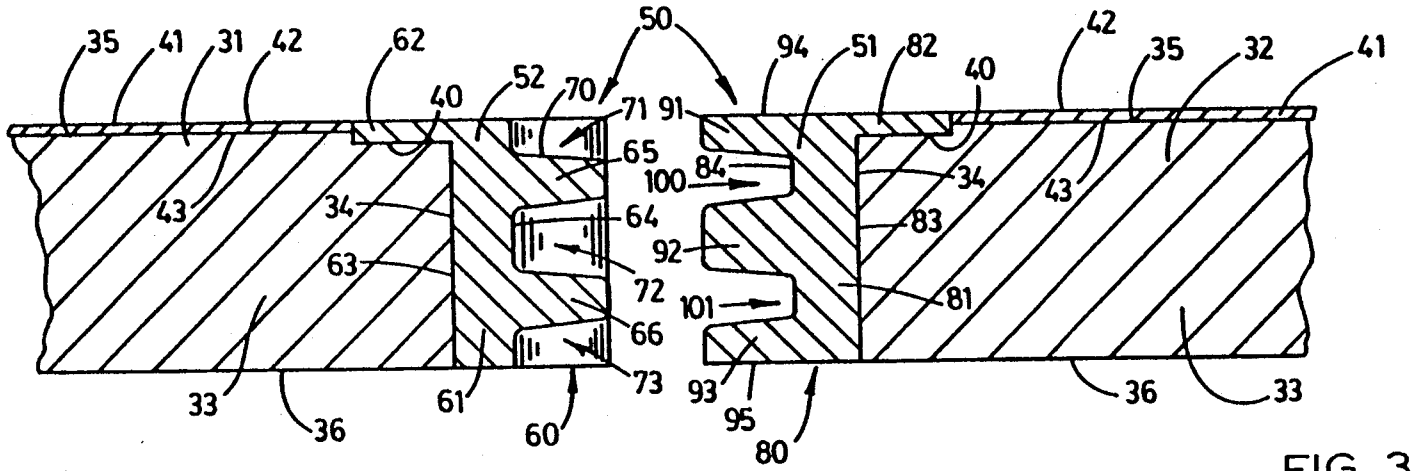
FIG. 3 is a longitudinal, transverse, vertical sectional view taken from a position along line 3—3 of FIG. 2.
Figure 4:
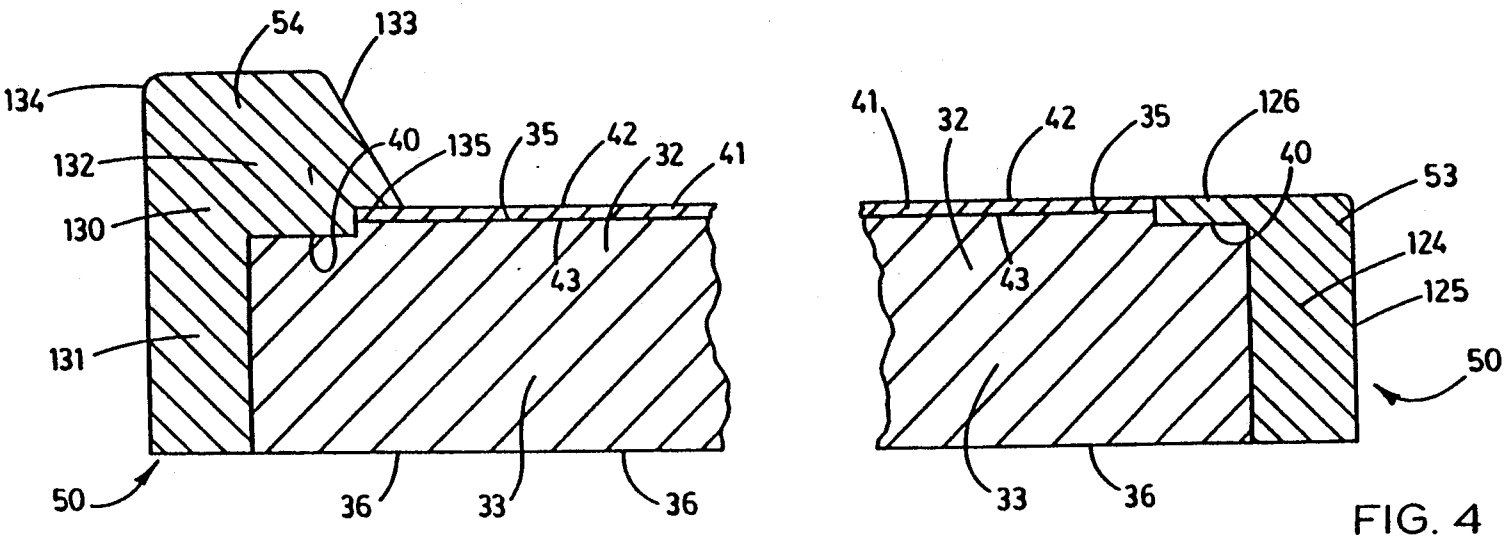
FIG. 4 is a transverse, vertical sectional view taken from a position along line 4—4 of FIG. 2.

As best illustrated by reference to FIGS. 2, 3, and 4, the working surface 10 includes a plurality of edge members which are generally indicated by the numeral 50, and which will hereinafter be designated as a first edge member 51, a second edge member 52, a forwardly disposed edge member 53, and a rearwardly disposed edge member 54.

As best illustrated by reference to FIGS. 2 and 3 a generally frusto-triangular shaped female receiving station or recess 60 is made integral with the second ends 45 of the first and second portions 31 and 32, respectively. As shown, the female receiving station is formed into or made integral with the second edge member 52. However it should be understood that the female receiving station could alternatively be formed into the main body 33.

The individual edge members 51 through 54, respectively, are formed from cast polyurethane or other synthetic materials which may be extruded or otherwise formed to shape. The features of the edge members will be discussed in the paragraphs which follow, however, it should be understood that the edge members including the female receiving station and male portion form a joint which is tight fitting such that it will prevent leakage but which further facilitates disassembly when that event becomes necessary. The male portion will be discussed hereinafter. As best seen by reference to FIG. 3, the female receiving station has a main body 61 which includes a top flange member 62 which is positioned in substantially normal relation relative to the main body and which extends substantially longitudinally inwardly relative to the second end 45. The top flange member 62 has thickness and width dimensions which permit it to be matingly received in the recessed channel 40 which is formed in the second end of the individual portions 31 and 32, respectively. The main body 61 of the second edge member 52 includes a substantially vertically disposed and inwardly facing surface 63, and an outwardly facing surface 64. The inwardly facing surface 63 is affixed to the second end of the individual portions by utilizing a suitable fastening technique such as by the use of adhesives, screws or other like fasteners. The female receiving station, and more particularly the outwardly disposed surface thereof includes first and second ribs which are generally indicated by the numeral 65 and 66, respectively and which extend substantially longitudinally outwardly relative to the outwardly disposed surface. As best shown by reference to FIG. 3, the respective ribs have a substantially frusto-triangular cross-sectional shape and are further disposed in substantially parallel relation relative to the top and bottom surfaces 35 and 36 of the main body 33. Further, it should be understood that the first and second ribs are disposed in predetermined spaced relation relative to the top and bottom surfaces thereby defining respective first, second and third channels 71, 72, and 73, which have individual predetermined shapes.

The working surface 10 of the present invention includes a male portion 80 which is made integral with the first end 44 of the first and second portions, respectively, and which extends substantially longitudinally outwardly relative to the respective first ends. As illustrated most clearly by reference to FIG. 2, the male portion is made integral with the first edge member 51, which, as earlier discussed is manufactured from cast polyurethane or other similar materials. The male portion has a main body 81 which includes a top flange member 82 which extends substantially longitudinally, inwardly, relative to the first end of the respective portions and which further is disposed in a substantially normal attitude relative to the main body 81. Further, the top flange member 82 has width and thickness dimensions such that it is matingly received in the channel 40 which is formed in the peripheral edge of the respective first and second portions 31 and 32, respectively. The male portion has vertically disposed and opposite, inwardly and outwardly facing surfaces 83 and 84, respectively. In addition to the foregoing, the male portion includes first, second, and third ribs 91, 92, and 93, respectively, which are individually positioned in predetermined spaced relationship one to the other. As best illustrated by reference to FIG. 3, the first and third ribs of the male portion have exterior and interior facing surfaces 94 and 95, respectively and wherein the exterior facing surfaces of the respective ribs are disposed in a substantially coplanar attitudes relative to the bottom surface 3 and the outwardly disposed surface 42 of the exterior supporting surface 41, respectively. The first, second and third ribs 91, 92 and 93, respectively, define top and bottom channels 100 and 101, respectively, which are dimensioned and positioned so as to slidably and releasably mate with the first and second ribs 65 and 66, respectively. Similarly, the first, second and third ribs 91, 92, and 93, respectively are each positioned so a to be slidably and releasably received in the first, second and third channels 71, 72, and 73, respectively. In addition to the foregoing, and as best illustrated by reference to FIG. 2 it should be understood that the female receiving station 60 and the male portion 80 each have respective overall length dimensions which are less than the length dimensions of the first and second ends 44 and 45 of the first and second portions 31 and 32, respectively. Also, the respective shapes of the female receiving station and male portion are complimentary. These two elements in combination comprise an alignment means which permits the respective first and second portions to be aligned in juxtaposed substantially longitudinal and coaxial end-to-end relation one with the other. Further, the alignment means prohibits any movement of the respective portions along paths of movement which are substantially parallel to the transverse links of reference 21.

As best seen by reference to FIG. 2 the working surface 10 includes a pair of end caps which are generally indicated by the numeral 110, and which includes a male end cap 111 and a female end cap 112. Each of the respective end caps has a main body 113 which includes an exterior facing surface 114, and an opposite, interior facing surface 115. Further each of the end caps includes a raised rearward end portion 116 which substantially conformably matches the rearwardly disposed edge member 54. The female end cap 112 includes a complimentary, substantially frusto-triangular shaped cavity 120 which is operable to receive the male portion 80 which is made integral with the first end 44 of the respective portions. The cavity 120 includes a plurality of ribs 121 which are spaced to provided channels which are operable to receive the first, second and third ribs 91, 92 and 93 of the male portion in the manner as previously described. It should be understood, therefore, that the cavity 120 and more particularly the ribs 121 provides a convenient means for interlocking the end cap on the first end 44 of the first portion 31 and which further can be readily removed such that this portion may be interlocked or otherwise releasably joined with an adjoining portion in the event that the working surface 10 needs to be rearranged or reconfigured, or further in the event that the individual portions need to be repaired or replaced. The male end cap 111 includes a male portion 122 which has a plurality of ribs 123 which are individually operable to mate with the female receiving station 60 which is made integral with the second end 45 of the second portion 32.

The rearwardly disposed edge member 54 includes a main body 130 which has a substantially vertically disposed portion 131 and a horizontally disposed portion 132. As best illustrated by reference to FIG. 4, the horizontally disposed portion has a forward or leading edge 133 which provides a barrier to inhibit an object of interest (not shown) but which could include water, or other materials, from falling off of the supporting surface 41. Further the vertical portion has a rearward or trailing edge 134. As best illustrated by reference to FIG. 4, a channel 135 is formed in the leading edge !33 and thereby permits the rearwardly disposed edge member to securely mate with the rearwardly disposed peripheral edge of the main body. The rearwardly disposed edge member is fixed to the main body by employing adhesives or other screw-type fasteners, not shown.

OPERATION

The described embodiment of the present invention is believed to be readily apparent and is briefly summarized at this point.

The working surface 10 of the present invention includes a substantially planar main body 33 having a peripheral edge 34 and first and second ends 44 and 45, and wherein the first end has a male portion 80 and the second end has a female receiving station 60. The working surface 10 is secured to the underlying cabinets 12 by conventional fasteners, not shown. The male portion and the female receiving station have complimentary shapes whereby individual portions 31 and 32 may be releasably joined together in juxtaposed substantially coaxial mating relation to form a substantially continuous supporting surface 42 which is best seen by reference to FIG. 1. As best illustrated by reference to FIG. 2 and 3 the female receiving station which is positioned on the second end of the first portion includes first and second ribs 65 and 66 which are individually positioned in predetermined spaced relation relative to the outwardly disposed surface of the first portion and with each other. The individual ribs 65 and 66 are oriented in planes which are substantially parallel to the plane of the supporting surface. Further the male member is made integral with the peripheral edge and first end of the second portion and is operable to releasably mate with the female receiving station. The male member includes three spaced ribs 91, 92 and 93 which are individually oriented in planes which are substantially parallel to the plane of the supporting surface of the second portion. As best illustrated by reference to FIG. 3 the ribs of the male portion and female receiving station respectively are shaped so as to define predetermined channels which are adapted to receive the ribs of the other element such that the individual portions may be oriented in substantially the same plane and in substantially coaxial alignment. The individual portions 31 and 32 include a rearwardly disposed peripheral edge member 54 which provides a barrier to inhibit liquids or other objects of interest from falling off the rearwardly disposed peripheral edge of the portion.

Therefore, it will be seen that the working surface 10 provides a fully dependable and practical means for forming a substantially continuous working surface and further provides a convenient means whereby discrete sections or portions of a working surface may be selectively removed for repair and/or replacement. In addition to the foregoing the working-surface is characterized by ease of installation, simplicity of construction and further can be sold and maintained at a relatively nominal expense.

Although the invention has been herein shown and described in what is conceived to be the most practical and preferred embodiment, it is recognized that departures may be made therefrom within the scope of the invention which is not to be limited to the illustrative details disclosed.

Having described our invention what we claim as new and desire to secure by Letters Patent is:

1. A working surface comprising:

a substantially planar main body having a peripheral edge and first and second ends, and wherein the first and second ends have predetermined dimension and the working surface has a longitudinal line and reference, and wherein the first end has a male portion, and the second end has a female receiving station, and wherein the male portion and the female receiving station have length dimensions which are less than the length dimensions of the first and second ends respectively, and have individual substantially complementary shapes, and wherein the male portion extends substantially longitudinally outwardly relative to the main body and the female receiving station extends substantially longitudinally inwardly relative to the main body, and wherein a plurality of ribs are made integral with the female receiving station and male portion respectively, and wherein the respective ribs are disposed in predetermined spaced, substantially parallel relation relative to each other, and wherein the respective ribs define channels therebetween which have predetermined cross-sectional shapes, and wherein the respective ribs are received in a selected one of the channels formed by the ribs which are made integral with the other portion whereby the individual working surfaces may be releasably and coaxially joined together in juxtaposed relation to form a substantially continuous supporting surface.

2. A working surface as claimed in claim 1, and wherein the female receiving station includes a pair of ribs which define first, second and third channels, and wherein the male member includes three ribs which are individually operable to be received in the first, second and third channels respectively, and wherein the three ribs define two channels which are operable to receive the pair of ribs which are made integral with the female receiving station.

3. A working surface as claimed in claim 2, and wherein the female receiving station and the male member have respective length dimensions, and wherein the individual ribs which are made integral with the female receiving station, and with the male member, have respective length dimensions which are substantially equal to the length dimensions of the respective female receiving station and male member.

4. A working surface as claimed in claim 3, and wherein a raised edge member is made integral with the rearwardly disposed peripheral edge of the first and second portions respectively.

5. A working surface having a substantially continuous supporting surface comprising:

first and second portions, each having opposite ends, forwardly and rearwardly disposed peripheral edges, and a longitudinal line of reference; and means mounted on the first and second portions for releasably and matingly interlocking the first and second portions in predetermined, juxtaposed, end-to-end relation thereby positioning the respective longitudinal lines of reference in substantially coaxial alignment and forming a substantially continuous supporting surface, and wherein the interlocking means is disposed on the opposite ends and substantially intermediate the forwardly and rearwardly disposed peripheral edges of the respective first and second portions, and wherein the interlocking means further includes means for aligning the first and second portions in substantially the same plane, the aligning means including a female receiving station which is formed in one end of the first portion, and which has a length dimension which is less than the length dimension of the end of the first portion, and a male member which is made integral with one end of the second portion, and wherein the respective female receiving station and male member having complementary shapes, and wherein the interlocking means further includes a plurality of ribs which are made integral with the female receiving station and the male member respectively, and wherein the respective ribs are disposed in predetermined spaced, substantially parallel relation relative to each other and with the supporting surface, and wherein the respective ribs define channels therebetween which each have predetermined cross-sectional shapes and dimensions, and wherein the respective ribs made integral with the female receiving station, and male member, are disposed in predetermined positions such that each rib may be received in one of the channels formed in the other portion thereby forming a substantially continuous surface and fixing the first and second portions in end-to-end relation.

6. A working surface as claimed in claim 5, and wherein the female receiving station includes a pair of ribs which define first, second and third channels, and wherein the male member includes three ribs which are individually operable to be received in the first, second and third channels respectively, and wherein the three ribs define two channels which are operable to receive the pair of ribs which are made integral with the female receiving station.

7. A working surface as claimed in claim 6, and wherein the female receiving station and the male member have respective length dimensions, and wherein the individual ribs which are made integral with the female receiving station, and with the male member, have respective length dimensions which are substantially equal to the length dimensions of the respective female receiving station and male member.

8. A working surface as claimed in claim 7, and wherein a raised edge member is made integral with the rearwardly disposed peripheral edge of the first and second portions respectively.

9. A working surface comprising:

first and second portions each having a supporting surface, a peripheral edge, including forwardly and rearwardly disposed portions, and first and second ends respectively, and wherein the second end of the first member is disposed in juxtaposed relation relative to the first end of the second member;

a female receiving station formed in the peripheral edge and second end of the first member, and wherein the receiving station includes first and second rib members which are individually disposed in predetermined spaced relation relative to the supporting surface of the first member and to each other, the individual ribs oriented in planes which are substantially parallel to the plane of the supporting surface;

a male member made integral with the peripheral edge and first end of the second portion and which is operable to releasably mate with the female receiving station, the male member including three spaced ribs which are individually oriented in planes which are substantially parallel to the plane of the supporting surface of the second portion; and a raised edge member positioned along the rearwardly disposed peripheral edge of the first and second portions respectively, and wherein the first and second portions of the working surface, when disposed in mating relation provides a substantially continuous supporting surface, and wherein the raised edge members operates as a barrier to prevent an object of interest from falling off the rearward peripheral edge.

10. A working surface as claimed in claim 9 and wherein the second end of the first portion has a predetermined length dimension, and wherein the female receiving station is defined by a recessed area formed in the second end, the recessed area having a predetermined depth dimension and a length dimension which is less than the length dimension of the second end.

11. A working surface as claimed in claim 10 and wherein the first and second portions of the working surface have a bottom supporting surface, and wherein the first and second ribs of the first portion are substantially frusto-triangular shaped in cross section and which extend substantially longitudinally outwardly and at a substantially parallel attitude relative to the supporting surface, and wherein the first and second ribs are disposed in positions intermediate the supporting and bottom surfaces, and wherein the first and second ribs define first, second and third channels having predetermined cross-sectional dimensions.

12. A working surface as claimed in claim 11 and wherein the plurality of ribs of the second portion includes first, second and third ribs which are disposed in substantially equally spaced relation relative to each other, and wherein the first, second and third ribs define respective channels therebetween which are complementary in shape and which are adapted matingly to receive the first and second ribs of the first portion, and wherein the first end of the second portion has a predetermined length dimension and the male member of the second portion has a length dimension which is less than the length dimension of the first end and substantially equal to the length dimension of the recessed area.

13. A working surface as claimed in claim 12 and wherein the first and third ribs of the second portion each have an exterior surface which includes outwardly facing and inwardly facing surfaces, and wherein the outwardly facing surfaces of the first and third ribs are substantially coplanar with the top and bottom supporting surfaces of the first and second portions respectively, and wherein the second rib of the second portion is substantially frusto-triangular in cross section, and wherein the first, second and third ribs are individually received in the first second and third channels respectively.

14. A working surface as claimed in claim 13 and wherein the male member and female receiving station are substantially complementary in shape.

15. A working surface as claimed in claim 14 and wherein male and female end caps are operable to releasably mate with the first end of the first portion and the second end of the second portion respectively.

* * * * *

UNITED STATES PATENT AND TRADEMARK OFFICE

CERTIFICATE OF CORRECTION

PATENT NO. : 5,018,628

DATED : May 28, 1991

INVENTOR(S) : ROBERT SCHENCK ET AL.

It is certified that error appears in the above—identified patent and that said Letters Patent is hereby corrected as shown below:

Column 3, Line 19, cancel "proVide" and insert --- provide ---;

Column 5, Line 5, cancel "3" and insert --- 36 ---;

Signed and Sealed this

Twenty-fourth Day of September, 1991

*Attest:*

HARRY F. MANBECK, JR.

*Attesting Officer*

*Commissioner of Patents and Trademarks*